US006688924B2

(12) United States Patent
Marsland et al.

(10) Patent No.: US 6,688,924 B2
(45) Date of Patent: Feb. 10, 2004

(54) TWO-ENGINE PROPULSION SYSTEM FOR A SHIP

(75) Inventors: George Marsland, Kressbronn (DE); Günter Rothenhäusler, Ravensburg (DE); Winfried Bareth, Kressbronn (DE); Franco Bennati, Nonnenhorn (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 10/182,153

(22) PCT Filed: Jan. 30, 2001

(86) PCT No.: PCT/EP01/00965

§ 371 (c)(1),
(2), (4) Date: Jul. 25, 2002

(87) PCT Pub. No.: WO01/56877

PCT Pub. Date: Aug. 9, 2001

(65) Prior Publication Data

US 2003/0003817 A1 Jan. 2, 2003

(30) Foreign Application Priority Data

Feb. 4, 2000 (DE) ..... 100 05 050

(51) Int. Cl.[7] ..... B63H 23/10
(52) U.S. Cl. ..... 440/4; 440/75
(58) Field of Search ..... 440/4.75

(56) References Cited

U.S. PATENT DOCUMENTS 4,568,289 A 2/1986 Heidrich et al. ..... 440/3

FOREIGN PATENT DOCUMENTS

EP 0 246 631 A1 11/1987 ..... B63H/23/18
EP 0 249 208 A1 12/1987 ..... B63H/23/18
EP 0 509 712 A1 10/1992 ..... B63H/23/10

OTHER PUBLICATIONS

Hansa–Schiffahrt–Schiffbau–Hafen, *Zahnradfabrik Friedrichshafen AG*, 133, No. 4, 1996, pp. 22–28.

Hoppe, Franz, "Hochleistungsgetriebe Fü r Schiffe", *Antriebstechnik* 33, No. 9, 1994, pp. 50–51.

Schiff & Hafen, Schnell, schneller . . . "HSS 1500", Prospekt: ZF–Schiffsgetriebe–BWK 1200, BWK 1500 and BWK 200, *Zahnradfabrik Friedrichshafen AG*, 1981, pp. 22–28.

*Primary Examiner*—Jesus D. Sotelo
(74) *Attorney, Agent, or Firm*—Davis & Bujold, PLLC

(57) ABSTRACT

A propulsion system for a ship having one front and one rear propelling engine (M1, M2), the propulsion powers of which can be coupled to an output shaft (7) via a gear system (6). The shafts of the gear mechanism are disposed on top of each other in an essentially vertical manner. The ship output shaft (7) extends below the rear propelling engine (M2). It is proposed that an input gear (14), disposed upon a rear input shaft (10), is permanently meshed with an intermediate gear (Z2) disposed upon a first axis of rotation (1), and that an output gear (13) disposed upon a gear output shaft (11) likewise meshes with an intermediate gear (Z1) disposed upon the first axis of rotation (1) whereby a large vertical axial distance results between the rear input shaft (10) and the gear output shaft (11) despite the small gear diameter.

15 Claims, 3 Drawing Sheets

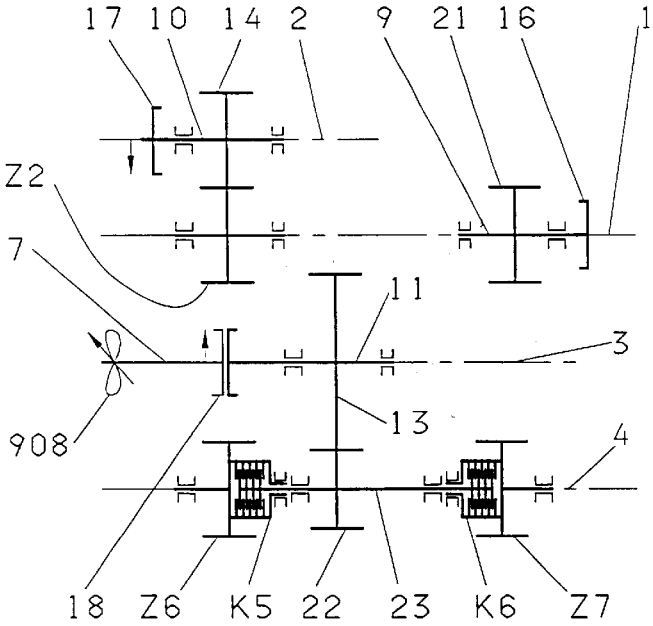
Fig. 9
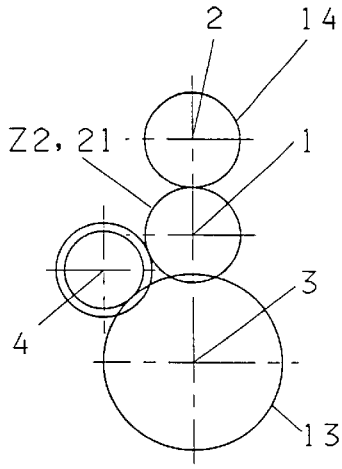
Fig. 10
| Propelling Engine | Direction of Rotation | Gear | K1 | K2 | K3 | K4 | K5 | K6 | K7 | K8 |
|---|---|---|---|---|---|---|---|---|---|---|
| Front | Clockwise | 1 | | | | • | | | | |
| | | 2 | • | | | | | | | |
| | Counterclockwise | 1 | | | | | | | | • |
| | | 2 | | | | | | • | | |
| Rear | Clockwise | 1 | | | • | | | | | |
| | | 2 | | • | | | | | | |
| | Counterclockwise | 1 | | | | | | | • | |
| | | 2 | | | | | • | | | |
| Front + Rear | Clockwise | 1 | | | • | • | | | | |
| | | 2 | • | • | | | | | | |
| | Counterclockwise | 1 | | | | | | | • | • |
| | | 2 | | | | | • | • | | |
Fig. 11

TWO-ENGINE PROPULSION SYSTEM FOR A SHIP

FIELD OF THE INVENTION

The invention relates to a system of propulsion for a ship comprising a front and a rear propelling engine the propulsion powers of which can be coupled to an output shaft via a gear system, said output shaft being passed through below the rear propelling engine.

BACKGROUND OF THE INVENTION

Already known are propulsion systems for ships in which two propellers can be driven by two—equal or different—propelling engines. Depending on the power requirement propulsion systems for ships, having several prime movers, permit driving only one or more prime movers. A lower fuel consumption is hereby achieved in the area of a part load. Besides, the reliability of operation increases, since even in case of failure of individual propelling engines, the ship remains capable of maneuvering.

Particularly in heavy-duty ships, such as catamaran ferries which can attain very high speeds, special requirements are placed on the propulsion system. They must have light weight and claim only narrow installation space because of the narrow hulls. Between conventionally used, high-speed diesel engines and their ship output shaft, which drives a propeller or other output element of the ship, only relatively small ratios are needed in the gear between the input shafts and the output shaft due to the high speeds of the ship under certain propelling variants.

Large ships are usually optimized especially to a provided use profile. Different propulsion plans with stationery or adjustable propellers with so-called waterjet propulsions are used here. Accordingly different demands are placed on the ship propulsion systems and the ship gear mechanism thereof which demands as a rule require, expensive special solutions.

By prior use has become known, a ship gear system in which two propelling engines are disposed consecutively in longitudinal direction and their propulsion powers can be coupled to a ship output shaft, via a gear mechanism, situated between the propelling engines, the ship output shaft being passed through below the rear propelling engine. Determined by the kind of construction, the input shaft of the rear propelling engine has only a small axial distance from the output shaft. In order that the ship output shaft can be passed through below, the rear propelling engine, in this gear system the rear propelling engine is coupled to the gear mechanism with large axial distance by means of a suitable cardan shaft. The required large axial installation space made necessary by a large engine space is disadvantageous here. But large continuous spaces, uninterrupted by a partition, are unfavorable for safety reasons. In addition, the rear propelling engine is installed, tilted in relation to the other components of the propulsion system. By the cardan shaft that extends inclined, undesirable vibrations can be excited in the drive chain. Both propelling engines also have, relative to each other, a horizontal offset so that the propulsion system is altogether built wider than were actually needed, based on the measurements of the individual propelling engines.

EP 0 509 712 A1 has finally disclosed a ship propulsion system, having a front and a gear propelling engine, the propulsion powers of which can be coupled to a ship output shaft, via a gear system, consisting of two interconnected gears. Both the input shafts and the output shaft of said gear system are only vertically offset in relation to each other so that both propelling engines can be situated in the ship hull without horizontal offset thus saving space. The vertical axial distance between the rear input shaft and the output shaft is large enough for a cardan shaft to be omitted between the rear propelling engine and the gear system. This ship propulsion system, of course, has some disadvantages. The use of two interconnected gears results in a higher total weight and the need of a larger axial installation space. In the fitting in the ship, great expenditure in assembly and alignment is required in order to prevent mutual restraints. The gear system also has a very large number of parts. In the arrangement shown with opposite output sides of the propelling engines, it is also required to use propelling engines having opposite directions of rotation.

Therefore, the problem on which this invention is based is to provide a ship propulsion system which is of simpler construction, needs less installation space, has a light weight despite a relatively small ratio and allows the utilization of propelling engines that rotate in the same direction. The ship propulsion system must also be adaptable at low expense to the requirements established by different propulsion plans.

SUMMARY OF THE INVENTION

The inventive propulsion system for ships has one gear mechanism in which the front input shaft is situated upon a first axis of rotation, the rear input shaft upon a second axis of rotation and the output shaft upon a third axis of rotation. The second axis of rotation extends vertically here above the first axis of rotation and the first axis of rotation vertically above the third axis of rotation. One input gear placed upon the rear input shaft is permanently meshed with an intermediate gear placed upon the first axis of rotation of the front input shaft and an output gear placed upon the gear output shaft is simultaneously engaged with an intermediate gear placed upon the first axis of rotation. Hereby results a large vertical axial distance between the rear input shaft and the gear output shaft.

With a relatively small ratio of 2:1, for example, between the input and the output shaft, there can also be used gear wheels of smaller diameter, since the axial distance between the axes of rotation is added. The point of gravity of the front propelling engine is lower in the ship hull than in the rear propelling engine, which is favorable with regard to a stablest possible position of the ship.

Sparing place both propelling engines can be disposed without horizontal axial distance when the second axis of rotation extends without horizontal offset exactly in vertical manner over the first axis of rotation. The maximum axial distance between the rear input shaft and the gear output shaft is obtained when the third axis of rotation extends without horizontal offset in exactly vertical manner below the first and the second axes of rotation.

In a preferred embodiment, the first, the second and the third axes of rotation extend parallel to each other. Only cylindrical spur gears are necessary here in the gear mechanism and both propelling engines can be installed parallel to each other. Alternatively a so-called down-angle arrangement is also possible in which the gear output shaft extends downwardly inclined. The gear output step is, in this case, a bevel gear step. The advantage of such an arrangement consists in that both propelling engines can be installed horizontally in the ship while the ship output shaft can be passed through the bottom of the hull with an angle of inclination.

Together with the inventive ship gear system and the developments thereof, protection is claimed also for a ship gear mechanism of such a ship gear system.

BRIEF DESCRIPTION OF THE DRAWINGS

The invention will now be described, by way of example, with reference to the accompanying drawings in which:

FIG. 9 is a gear diagram of an embodiment in side view;

FIG. 10 is a top view upon the gear diagram of the embodiment according to FIG. 9; and FIG. 11 is a table of the shift states of the separating clutches.

In the Figures, positions corresponding to each other are provided with the same reference numerals.

DETAILED DESCRIPTION OF THE INVENTION

Figure 1:
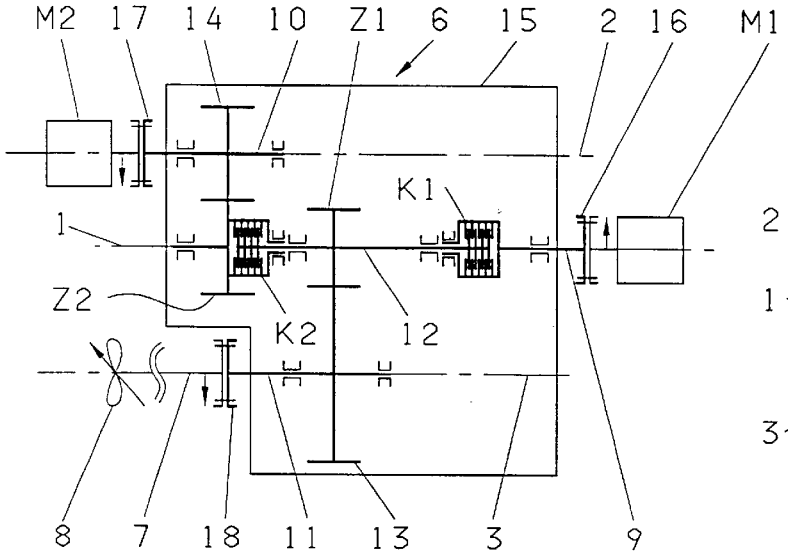
FIG. 1 diagrammatically shows a side view of an inventive ship propulsion system.

In FIG. 1, a rear propelling engine M2 and a front propelling engine M1 of a ship propulsion system is designated. Both propelling engines M2, M1, designed as diesel engines, for example, can be coupled via one gear system 6, the driving power being fed via a ship output shaft 7 to an output element (what is shown is a variable pitch propeller 8). The gear mechanism 6 has one front input shaft 9 allocated to the front propelling engine M1; one rear input shaft 10 allocated to the rear propelling engine M2 and one gear output shaft 11 allocated to the ship output shaft 7. The front input shaft 9 has a first axis of rotation 1, the rear input shaft 10 a second axis of rotation 2 and the gear output shaft 11 a third axis of rotation 3.

Figure 2:
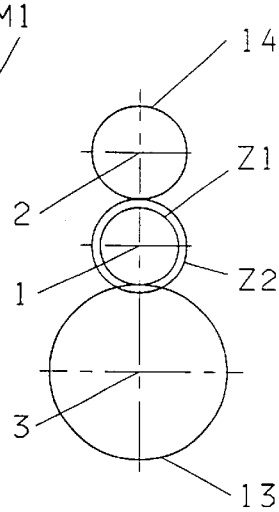
FIG. 2 is a top view upon the gear diagram of a ship gear mechanism according to FIG. 1.

As can be seen from FIG. 2, the first axis of rotation lies vertically above the third axis of rotation and the second axis of rotation is vertically above the first axis of rotation. The axial distance between the rear input shaft 10 and the gear output shaft 11 is large enough to allow the ship output shaft 7 to extend through below the rear propelling engine in direction to the ship stern. Upon the first axis of rotation 1 a first intermediate gear Z1 is rotatably supported by an intermediate shaft 12. The intermediate gear Z1 can optionally be coupled by a first separating clutch K1 to the front input shaft 9 and/or by mean of a second separating clutch K2 to a second intermediate gear Z2 which is also rotatably supported upon the first axis of rotation. The intermediate gear Z1 is permanently meshed with the output gear 13 situated upon the gear output shaft 11. The intermediate gear Z2 is permanently meshed with a rear input gear 14 non-rotatably placed upon the gear input shaft 10. Outside the gear housing 15, made of light metal, a rear and a front input flangel 16, 17 are located, the same as the gear output flange 18. A great vertical axial distance exists between the rear input shaft 10 and the gear output shaft 18 so that the ship output shaft 7 can be passed through without a problem below the rear propelling engine M2.

The embodiment shown in FIG. 1, makes the ship output shaft 7 optionally possible to actuate by the front propelling engine M1 and/or the rear propelling engine M2. With closed separating clutch K1, the front propelling engine M1 is coupled to the ship output shaft 7 with closed separating clutch K2, the rear propelling engine M2 is coupled to the ship output shaft 7. The separating clutches K1, K2 are hydraulically actuatable, power shiftable, wet disc clutches. This type of clutch makes smooth shifting operation possible. The separating clutches of the ship gear mechanism 6 can be controlled preferably by an electrohydraulic control device. The embodiment of FIG. 1 is especially suitable for ships where the output element is a variable propeller 8 in which a negative angle of incidence of the propeller blades can be controlled for reverse travel and the power consumption for the operation with only one propelling engine can be adapted by a small angle of incidence of the propeller blades. The rear input gear 14 forms with the intermediate gear Z2, a ratio step with the reduction ratio 1 so that both propelling engines M1, M2 are coupled to the ship output shaft 7 with the same reduction ratio. Since the propelling elements upon the first axis of rotation have a direction of rotation opposite to the propelling elements upon the second axis of rotation and the propelling sides of both propelling engines M1, M2 face each other, the two propelling engines have the same direction of rotation. Therefore, two identical propelling engines can be used. The plan of the represented ship propulsion system can be expanded so as to also meet requirements resulting from the use of other ship output elements.

Figure 3:
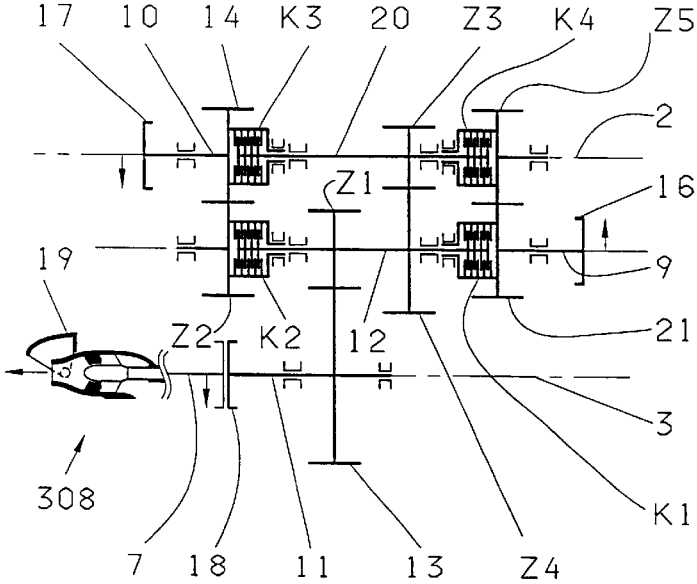
FIG. 3 is a gear diagram of an embodiment in side view.
Figure 4:
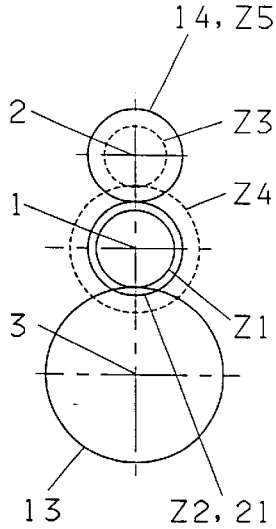
FIG. 4 is a top view upon the gear diagram of the embodiment according to FIG. 3.

In FIGS. 3 and 4 is shown an embodiment in which the ship output shaft 7 can optionally be actuated by the front and/or the rear propelling engine and, optionally, with a first ratio step—a first gear—or a second ratio step—a second gear. Such a ship propulsion system is adequate for propelling a so-called waterjet propulsion 308 where backward thrust is produced by a flap 19 tiltable in front of the water discharge opening. The embodiment according to FIG. 3 or FIG. 4 has the following additional elements: coaxially to the rear input shaft 10 is rotatably supported upon the second axis of rotation by an intermediate shaft 20 an intermediate gear Z3 which is permanently meshed with an intermediate gear Z4 which is connected upon the first axis of rotation, via the intermediate shaft 12, with the intermediate gear Z1. The intermediate gear Z3 can be optionally coupled via a separating clutch K3 to the rear input shaft 10 or via a separating clutch K4 to an intermediate gear Z5. The intermediate gear Z5 is likewise rotatably supported around the second axis of rotation and is permanently meshed with a front input gear 21 situated upon the front input 9. The reduction ratio formed between the intermediate gear Z3 and the intermediate gear Z4 is operative in first gear and is smaller than the reduction ratio formed between the rear input gear 14 and the intermediate gear Z2. To operate both propelling engines in the second gear, the clutches K1 and K2 are closed while the clutches K3 and K4 are open. The propelling power of the rear propelling engine is here transmitted via the gears 14, Z2, Z1 and 13 to the gear output 11. The propelling power of the front propelling engine is transmitted via the gears Z1 and 13 to the gear output shaft 11. The reduction corresponds to a top speed driving gear. If only the rear propelling engine is operated, only the separating clutch K3 is closed while the separating clutches K1, K2 and K4 are open. The power is transmitted via Z3, Z4, Z1 and 13 to the gear output 11.

The intermediate gear Z5 and the front input gear 21 are gear wheels having the same number of teeth so that they form a ratio step with the reduction ratio 1.

In this shifting state, therefore, the intermediate shaft 12 and the gear output shaft 11 rotate slower than the rear gear input shaft 10. The low rotational speed of the ship output shaft 11 or of the waterjet propulsion 308 produces a lower power consumption adapted to the propulsion power of a propelling engine. For exclusive operation of the front propelling engine, the separating clutch K4 is closed while the separating clutches K1, K2 and K3 are open. The propelling power is transmitted, via the front input gear 21, to the intermediate gear Z5 and from there, via the intermediate gear Z3, to the intermediate gear Z4 again to the intermediate shaft 12. From there, in turn, via the output steps Z1 and 13, to the gear output shaft 11. It is further possible to also couple both propelling engines simultaneously to the first gear corresponding to a slow moving gear upon the ship output shaft 7. This is advantageous, for example, in a motion with increased resistance. Here the separating clutches K3 and K4 are closed while the separating clutches K1 and K2 are open.

Figure 5:
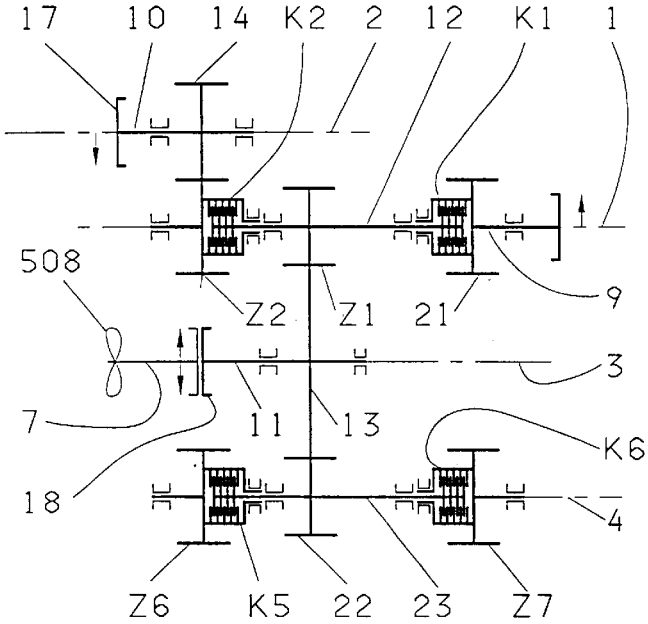
FIG. 5 is a gear mechanism diagram of an embodiment in side view.
Figure 6:
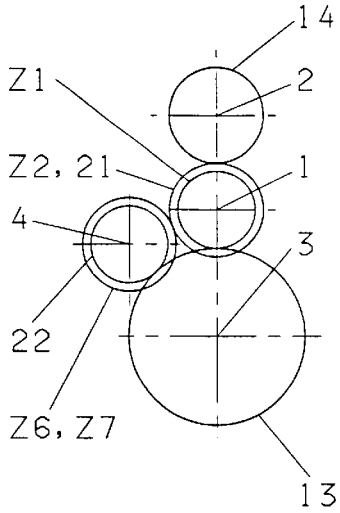
FIG. 6 is a top view upon the gear diagram of the embodiment according to FIG. 5.

The gear diagram shown in FIG. 5 and FIG. 6, concerns an embodiment of the invention where the ship output 7 can optionally be actuated by the front and/or the rear propelling engine and this clockwise or counterclockwise. The gear mechanism has a fourth axis of rotation 4 which is horizontally offset relative to the first and the third axes of rotation 1, 3 and is situated in vertical direction between the first and the third axes of rotation so that the centers of the first, third and fourth axes of rotation form a triangle. Upon the fourth axis of rotation 4 is rotatably supported a reversing gear 22 by an intermediate shaft 23 which can be optionally coupled by a separating clutch K5 to a coaxial intermediate gear Z7. The reversing gear 22 is permanently meshed with the output gear 13. The intermediate gear Z6 is permanently meshed with the intermediate gear situated upon the first axis of rotation and the intermediate gear Z7 is permanently meshed with the front input gear 21 non-rotatably placed upon the front input shaft 9.

To actuate the ship output shaft 7 clockwise by both propelling engines, the separating clutches K1 and K2 are closed while the separating clutches K5 and K6 are open. To actuate the ship output shaft 7 counterclockwise by both propelling engines, both separating clutches K5 and K6 are closed while the separating clutches K1 and K2 are open. To actuate the ship output shaft 7 clockwise by the front propelling engine, only the separating clutch K1 is closed while all the other separating clutches are open. With the same front engine, they can be actuated in opposite direction of rotation when the separating clutch K6 is closed and all the others are open. To actuate the ship output shaft 7 clockwise by the rear engine, only the separating clutch K2 is to be closed, to actuate with the rear propelling engine in opposite direction of rotation, exclusively the clutch K5 has to be closed. This embodiment is especially suitable when the gear output element is a fixed pitch propeller 508.

Figure 7:
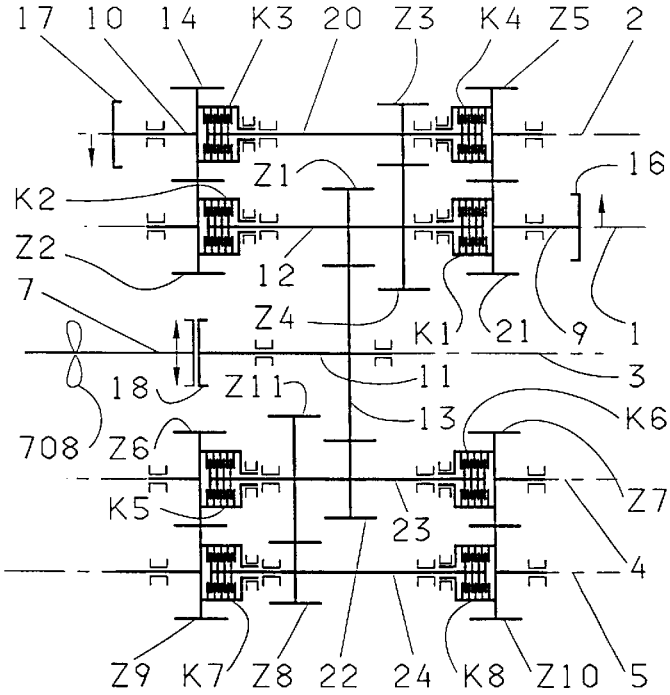
FIG. 7 is a gear diagram of an embodiment in side view.
Figure 8:
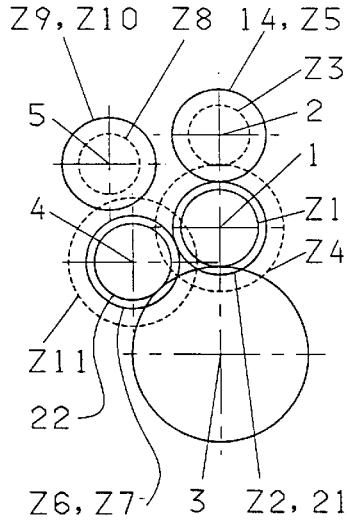
FIG. 8 is a top view of the gear diagram of the embodiment according to FIG. 7.

In FIGS. 7 and 9 is shown an embodiment where the ship output shaft 7 can optionally be actuated by the front and/or rear propelling engine and optionally clockwise or counterclockwise and with a first ratio step or a second ratio step. The gear mechanism has all the elements already described in FIG. 3 and FIG. 5. There is also a fifth axis of rotation 5 which is radially offset relative to the fourth axis of rotation 4. Upon the fifth axis of rotation 5 is rotatably supported by the intermediate shaft 24 an intermediate gear Z8 which can optionally be coupled by means of a separating clutch K7 to a coaxial intermediate gear Z9 and/or by a separating clutch K8 to a coaxial intermediate gear Z10. The intermediate gear Z8 is permanently meshed with an intermediate gear Z11 which is non-rotatably connected upon the fourth axis of rotation 4 by the intermediate shaft 23 with the reversing gear 22. The intermediate gear Z9 located upon the fifth axis of rotation is permanently meshed with the intermediate gear Z6 situated upon the fourth axis of rotation. The intermediate gear Z10 is permanently meshed with the intermediate gear 27. The reduction ratio formed between the intermediate gear Z11 and the intermediate gear Z8 is larger than the reduction ratio formed between the intermediate gear Z6 and the intermediate gear Z9. The gears 14, Z5, Z2, 21, Z6, Z7, Z9 and Z10 advantageously have the same toothing geometry or are equal parts. For the respective two gears Z3 and Z8, Z1 and 22, the same as Z4 and Z11, equal parts are likewise used. This embodiment is particularly adequate in combination with a fixed pitch propeller 708. On the basis of this embodiment can be derived an embodiment having only one reverse gear by omitting the elements disposed on the fifth axis of rotation. Should there be provided a gear mechanism with two forward gears and one reverse gear which, on the output, has opposite direction of rotation, there are needed, based on the embodiment shown in FIG. 7, only the front input gear 21 and the intermediate gear Z2 upon the first axis of rotation and only the rear input gear upon the second axis of rotation.

In the synoptic table shown in FIG. 11 with a black dot are identified the separating clutches K1 to K8 which are closed for the individual shifting states.

FIG. 9 and FIG. 10 finally show a gear diagram of an embodiment where the ship output shaft 7 can be optionally actuated by the front or rear propelling engine. The direction of rotation runs opposite to the embodiment shown in FIG. 1. Upon the first axis of rotation 1, the front input gear 21 is situated upon the front input shaft 9. Coaxially but independently thereof, an intermediate gear Z2 is rotatably supported, which is permanently meshed with the rear input gear 14 placed upon the rear input shaft 10. Upon the fourth axis of rotation 4, a reversing gear 22 is rotatably supported, which can be optionally coupled by means of a rear separating clutch K5 to another rear intermediate gear Z6 and/or by means of a front separating clutch K6 to another front intermediate gear Z7. The reversing gear 22 is permanently meshed with the output gear 13. The other rear intermediate gear Z6 is permanently meshed with the intermediate gear Z2 and the other front intermediate gear Z7 is permanently meshed with the front input gear 21. This embodiment of a ship propulsion system, which is adequate for combination with a feathered propeller 908, can be disposed, for example, in a hull of a catamaran ferry while in another hull an embodiment is provided such as shown in FIG. 1 and FIG. 2. In this manner, it is possible, therefore, to use four equal propelling engines altogether wherein the two propellers have opposite directions of rotation.

The inventive ship propulsion system is adaptable to various utilizations because of the variable construction of the gear mechanism. The individual configurations shown have very different jointly existing components like gear wheels and separating clutches which have identical construction. Hereby the maintenance and preservation of substitute parts is simplified.

All axes of rotation of the embodiments shown extend parallel to each other so that cylindrical gear wheel scan be used.

| Reference numerals | |
|---|---|
| 1 | axis of rotation |
| 2 | axis of rotation |
| 3 | axis of rotation |
| 4 | axis of rotation |
| 5 | axis of rotation |
| 6 | ship gear mechanism |
| 7 | ship output shaft |
| 8 | feathered propeller |
| 9 | front input shaft |
| 10 | rear input shaft |
| 11 | gear output shaft |
| 12 | intermediate shaft |
| 13 | output gear |
| 14 | rear input gear |
| 15 | gear housing |
| 16 | flange |
| 17 | flange |
| 18 | flange |
| 19 | hinged flap |
| 20 | intermediate shaft |
| 21 | front input gear |
| 22 | reversing gear |
| 23 | intermediate shaft |
| 24 | intermediate shaft |
| 308 | waterjet propulsion |
| 508 | fixed pitch propeller |
| 708 | fixed pitch propeller |
| 908 | feathered propeller |
| K1–K8 | separating clutches |
| AZ1–Z11 | intermediate gears |
| M1 | front propelling engine |
| M2 | rear propelling engine |

What is claimed is:

1. A propulsion system for a ship, comprising:

a front and a rear propelling engines (M1, M2) coupled via a gear system (6) to a ship output (7), a front input shaft (9) of the gear system, having a first axis of rotation (1) and allocated to the front propelling engine (M1), a rear input shaft (10) having a second axis of rotation (2) and allocated to the rear propelling engine (M2), and a gear output (11) having a third axis of rotation (3) and is allocated to the ship output shaft (7), wherein the ship output shaft (7) extends below the rear propelling engine (M2), the second axis of rotation (2) is disposed vertically above the first axis of rotation (1) and the first axis of rotation (1) is disposed vertically above the third axis of rotation (3), and the third axis of rotation (3) disposed vertically below the first axis of rotation (1) and the second axis of rotation (2), and wherein the gear system (6) has an input gear (14), mounted for rotation by the rear input shaft (10) and permanently meshed with a first intermediate gear (Z2) coaxial with the first axis of rotation (1) and an output gear (13), mounted for rotation by the gear output shaft (11) and meshed with a second intermediate gear (Z1) mounted rotating about the first axis of rotation (1)

so as to maximize the vertical axial distance between the rear input shaft (10) and the gear output shaft (11).

2. The propulsion system for a ship according to claim 1, wherein the second axis of rotation (2) extends without horizontal offset in an exactly vertical manner over the first axis of rotation (1).

3. The propulsion system for a ship according 2, wherein the third axis of rotation (3) extends without horizontal offset in an exactly vertical manner below the first and the second axes of rotation (1, 2).

4. The propulsion system for a ship according 1, wherein the first, second and the third axes of rotation (1, 2, 3) extend parallel to each other.

5. A propulsion system for a ship, comprising:

a front and a rear propelling engines (M1, M2) coupled via a gear system (6) to a ship output shaft (7), a front input shaft (9) of the gear system having a first axis of rotation (1) and allocated to the front propelling engine (M1), a rear input shaft (10) having a second axis of rotation (2) and allocated to the rear propelling engine (M2), and a gear output shaft (11) having a third axis of rotation (3) and allocated to the ship output (7), said ship output (7) extending below the rear propelling engine (M2), the second axis of rotation (2) being disposed above the first axis of rotation (1) and the first axis of rotation (1) being disposed above the third axis of rotation (3), wherein the gear system (6) has an input gear (14), mounted for rotation by the rear input shaft (10) and permanently meshed with a first intermediate gear (Z2) coaxial with the first axis of rotation (1) and an output gear (13), mounted for rotation by the gear output shaft (11) and meshed with a second intermediate gear (Z1) mounted rotating about the first axis of rotation (1) so as to maximize the vertical axial distance between the rear input shaft (10) and the gear output shaft (11) and wherein the first intermediate gear (Z1) is coupled by a first separating clutch (K1) to the front input shaft (9) and by a second separating clutch (K2) to the second intermediate gear (Z2) and the first intermediate gear (Z1) is permanently meshed with the output gear (13) so that the ship output shaft (7) can be optionally actuated by the front and the rear propelling engine (M1, M2).

6. The propulsion system for a ship according to claim 5, wherein the second intermediate gear (Z2) and the rear input gear (14) are gear wheels having equal number of teeth.

7. A propulsion system for a ship, comprising:

a front and a rear propelling engines (M1, M2) coupled via a gear system (6) to a ship output shaft (7), a front input shaft (9) of the gear system having a first axis of rotation (1) and allocated to the propelling engine (M1), a rear input shaft (10) having a second axis of rotation 2) and allocated to the rear propelling engine (M2), and a gear output shaft (11) having a third axis of rotation (3) and allocated to the ship output shaft (7), said ship output shaft (7) extending below the rear propelling engine (M2), the second axis of rotation (2) being disposed above the first axis of rotation (1) and the first axis of rotation (1) being disposed above the third axis of rotation (3), wherein the gear system (6) has an input gear (14), mounted for rotation by the rear input shaft (10) and a first intermediate gear (Z2) coaxial with the first axis of rotation (1) and an output gear (13), mounted for rotation by the gear output shaft (11) and meshed with a second intermediate gear (Z1) mounted rotating about the first axis of rotation (1) so as to maximize the vertical axial distance between the rear input shaft (10) and the gear output shaft (11) and wherein the first intermediate gear (Z1) is coupled by a first separating clutch (K1) to the front input shaft (9) and by a second separating clutch (K2) to the second intermediate gear (Z2) and the first intermediate gear (Z1) is permanently meshed with the output gear (13) so that the ship output shaft (7) can be optionally actuated by the front and the rear propelling engine (M1, M2) and wherein the second axis of rotation (2) rotatably supports a third intermediate gear (Z3) which is permanently meshed with a fourth intermediate gear (Z4) which is rotatable about the first axis of rotation and fixedly connected with the first intermediate gear (Z1), and wherein the third intermediate gear (Z3) can be optionally coupled via a third separating clutch (13) to the rear input shaft (10) and via a fourth separating clutch (K4) to a fifth intermediate gear (Z5) which is rotatable about the second axis of rotation (2) and permanently meshed with a front input gear (21) non-rotatably situated upon the front shaft (9), the reduction ratio formed between the third and the fourth intermediate gear (Z3, Z4) being smaller than the reduction ratio formed between the rear input gear (14) and the second intermediate gear (Z2) so that the ship output shaft (7) can be optionally actuated by the front and the rear propelling engine (M1, M2) and optionally with a first ratio step and a second ratio step.

8. The propulsion system for a ship according to claim 1, wherein the fifth intermediate gear (Z5) and the input gear (21) are gear wheels having equal number of teeth.

9. A propulsion system for a ship, comprising:

a front and a rear propelling engines (M1, M2) coupled via a gear system (6) to a ship output shaft (7), a front input shaft (9) of the gear system having a first axis of rotation (1) and allocated to propelling engine (M1), a rear input shaft (10) having a second axis of rotation (2) and allocated to the rear propelling engine (M2), and a gear output shaft (11) having a third axis of rotation (3) and allocated to the ship output shaft (7), said ship output shaft (7) extending below the rear propelling engine (M2), the second axis of rotation (2) being disposed above the first axis of rotation (1) and the first axis of rotation (1) being disposed above the third axis of rotation (3), wherein the gear system (6) has an input gear (14), mounted for rotation by the rear input shaft (10) and permanently meshed with a first intermediate gear (Z2) coaxial with the first axis of rotation (1) and an output gear (13), mounted for rotation by the gear output shaft (11) and meshed with a second intermediate gear (Z1) mounted about the first axis of rotation (1) so as to maximize the vertical axial distance the rear input shaft (10) and the gear output shaft (11) and wherein the first intermediate gear (Z1) is coupled by a first separating clutch (K1) to the front input shaft (9) and by a second separating clutch (K2) to the second intermediate gear (Z2) and the first intermediate gear (Z1) is permanently meshed with the output gear (13) so that the ship output shaft (7) can be optionally actuated by the front and the rear propelling engine (M1, M2), and wherein about a fourth axis of rotation (4), which is horizontally offset in relation to the first and the third axes of rotation (1, 3) and is disposed, in a vertical direction between the first and the third axes of rotation, a reversing gear (22) is rotatably supported which can optionally be coupled by mean of a fifth separating clutch (K5) to a sixth intermediate gear (Z6) and by mean of a sixth separating clutch (K6) to a seventh intermediate gear (Z7), the reversing gear (22) being permanently meshed with the output gear (13), the sixth intermediate gear (Z6) being permanently meshed with the second intermediate gear (Z2) and the seventh intermediate gear (Z7) being permanently meshed with the front input gear (21) non-rotatably placed upon the front input shaft (9) so that the ship output shaft (7) can be optionally actuated by the front and the rear propelling engine (M1, M2) and this optionally clockwise and counterclockwise.

10. The propulsion system for a ship according to claim 9, wherein upon a fifth axis of rotation (5), which is radially offset relative to the fourth axis of rotation (4), an eighth intermediate gear (Z8) is rotatably supported which can be optionally coupled by mean of a seventh separating clutch (K7) to a ninth intermediate gear (Z9) and by mean of an eighth separating clutch (K8) to a tenth intermediate gear (Z10), the eighth intermediate gear (Z8) being permanently meshed with an eleventh intermediate gear (Z11) which is non-rotatably connected, for rotation about the fourth axis of rotation (4) with the reversing gear (22), the ninth intermediate gear (Z9) being permanently meshed with the sixth intermediate gear (Z6) and the tenth intermediate gear (Z10) being permanently meshed with the seventh intermediate gear (Z7), whereby the reduction ratio formed between the eighth and the eleventh intermediate gear is smaller than the reduction ratio formed between the ninth and the sixth intermediate gear so that the ship output shaft can be optionally actuated by the front and the rear propelling engine and this optionally clockwise or counterclockwise and can be optionally actuated with a first ratio step or a second ratio step.

11. A propulsion system for a ship, comprising:

a front and a rear propelling engines (M1, M2) coupled via a gear system (6) to a ship output shaft (7), a front input shaft (9) of the gear system having a first axis of rotation (1) and allocated to propelling engine (M1), a rear input shaft (10) having a second axis of rotation (2) and allocated to the rear propelling engine (M2), and a gear output shaft (11) having a third axis of rotation (3) and allocated to the ship output shaft (7), said ship output shaft (7) extending below the rear propelling engine (M2), the second axis of rotation (2) being disposed above the first axis of rotation (1) and the first axis of rotation (1) being disposed above the third axis of rotation (3), wherein the gear system (6) has an input gear (14), mounted for rotation by the rear input shaft (10) and permanently meshed with a first intermediate gear (Z2) coaxial with the first axis of rotation (1) and an output gear (13), mounted for rotation by the gear output shaft (11) and meshed with a second intermediate gear (Z1) mounted rotating about the first axis of rotation (1) so as to maximize the vertical axial distance between the rear input shaft (10) and the gear output shaft (11) and wherein the first intermediate gear (Z1) is coupled by a first separating clutch (K1) to the front input shaft (9) and by a second separating clutch (K2) to the second intermediate gear (Z2) and the first intermediate gear (Z1) is permanently meshed with the output gear (13) so that the ship output shaft (7) can be optionally actuated by the front and the rear propelling engine (M1, M2), wherein for rotation about the first axis of rotation (1) are rotatably supported by the front input shaft (9), a front input gear (21), and an intermediate gear (Z2), wherein the intermediate gear (Z2) is permanently meshed with a rear input gear (4) disposed upon the rear input shaft (10), wherein upon a fourth axis of rotation (4) is rotatably supported a reversing gear (22) which can be optionally coupled by means of a rear separating clutch (K5) to another rear intermediate gear (Z6) and by mean of a front separating clutch (K6) to one other front intermediate gear (Z7) and wherein the reversing gear (22) is permanently meshed with the output gear (13), wherein the other rear intermediate gear (Z6) is permanently meshed with the intermediate gear (Z2) and the other front intermediate gear (Z7) is permanently meshed with the front input gear non-rotatably supported upon the front input shaft (9) so that the ship output shaft can be optionally actuated in opposite directions of rotation and optionally by front and the rear propelling engine.

12. The propulsion system for a ship according to claim 11, wherein at least two of the intermediate gears (Z1, Z2, Z3, Z4, Z5, Z6, Z7, Z8, Z9, Z10 and Z11) have the same tooth geometry.

13. The propulsion system for a ship according to claim 11, wherein at least two or more of the separating clutches (K1, K2, K3, K4, K5, K6, K7 and K8) are of identical construction.

14. The propulsion system for a ship according to claim 11, wherein the gear system (6) has a housing (15) made of light metal.

15. ship gear mechanism (6) of a ship propulsion system according to claim 11.

* * * * *